US007429711B2

(12) United States Patent
Machrowicz

(10) Patent No.: US 7,429,711 B2
(45) Date of Patent: Sep. 30, 2008

(54) METAL FORMING APPARATUS AND PROCESS WITH RESISTANCE HEATING

(75) Inventor: Tad Machrowicz, Ortonville, MI (US)

(73) Assignee: Noble Advanced Technologies, Inc., Warren, MI (US)

( * ) Notice: Subject to any disclaimer, the term of this patent is extended or adjusted under 35 U.S.C. 154(b) by 0 days.

(21) Appl. No.: 11/227,509

(22) Filed: Sep. 15, 2005

(65) Prior Publication Data

US 2006/0060570 A1 Mar. 23, 2006

Related U.S. Application Data

(60) Provisional application No. 60/610,720, filed on Sep. 17, 2004.

(51) Int. Cl.
*H05B 1/00* (2006.01)

(52) U.S. Cl. ..... 219/50; 219/161

(58) Field of Classification Search ..... 219/50, 219/158, 161, 162, 156; 72/342.92, 342.96
See application file for complete search history.

(56) References Cited

U.S. PATENT DOCUMENTS 2,972,043 A * 2/1961 Stich ..... 219/156
3,005,085 A * 10/1961 Vosbikian et al. ..... 219/50
3,705,973 A * 12/1972 Balzer et al. ..... 219/156
3,933,020 A 1/1976 Orr et al. ..... 72/297
5,410,132 A * 4/1995 Gregg et al. ..... 219/604
5,515,705 A * 5/1996 Weldon et al. ..... 72/19.1
5,737,954 A 4/1998 Yasui ..... 72/60
5,744,773 A 4/1998 Van Otteren et al. ..... 219/50
6,384,388 B1 5/2002 Anderson et al. ..... 219/602
6,463,779 B1 * 10/2002 Terziakin ..... 72/342.96
6,868,709 B2 3/2005 Adams et al. ..... 72/342.92
6,907,761 B2 * 6/2005 Spence et al. ..... 72/60

* cited by examiner

*Primary Examiner*—Kevin P Kerns
(74) *Attorney, Agent, or Firm*—Gifford Krass Sprinkle Anderson & Citkowski

(57) ABSTRACT

An apparatus for forming a metal article includes a station which receives and supports a workpiece. The station has a source of electrical current and a source of a fluid. The station further includes a first and a second electrode clamp. Each clamp is in electrical communication with the source of current and in fluid communication with the source of fluid. The clamps engage a workpiece and deliver an electrical current and a fluid thereto. The system includes an actuator mechanically associated with at least one of the clamps. The actuator is operable in combination with a clamp to apply mechanical force to the workpiece. The system is operable to selectably control the temperature profile and/or ambient conditions of a workpiece during forming or processing steps. Disclosed are specific systems including modular systems. Also disclosed are methods for using the systems.

16 Claims, 5 Drawing Sheets

FIG - 1E
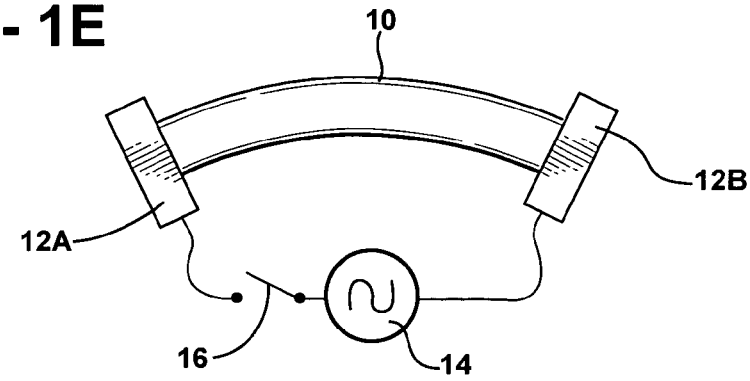
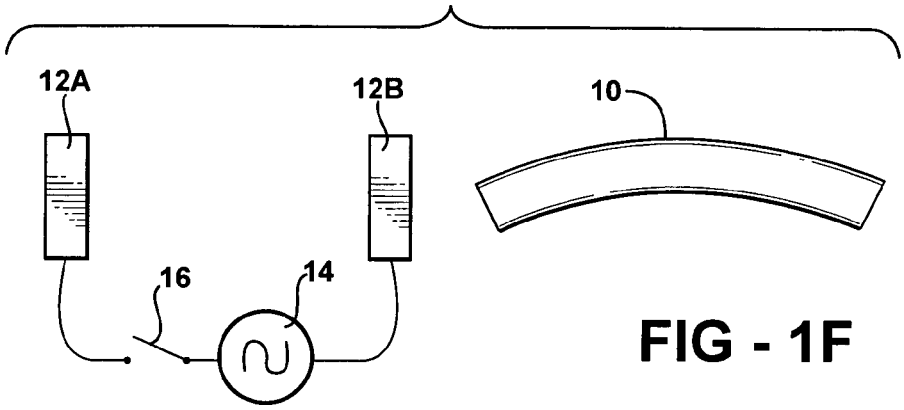
FIG - 1F
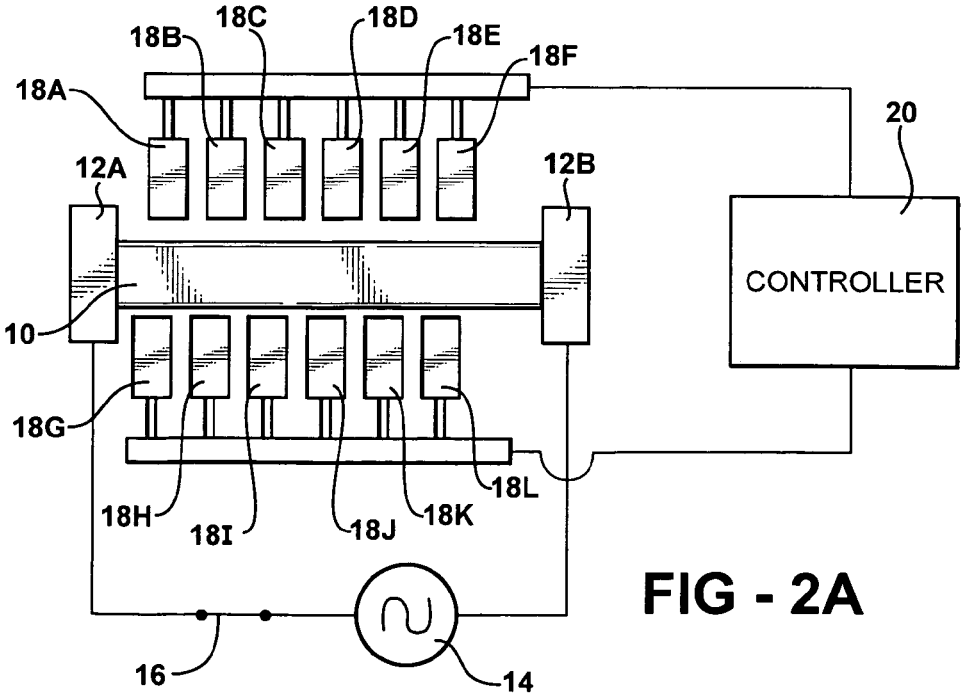
FIG - 2A

FIG - 2B
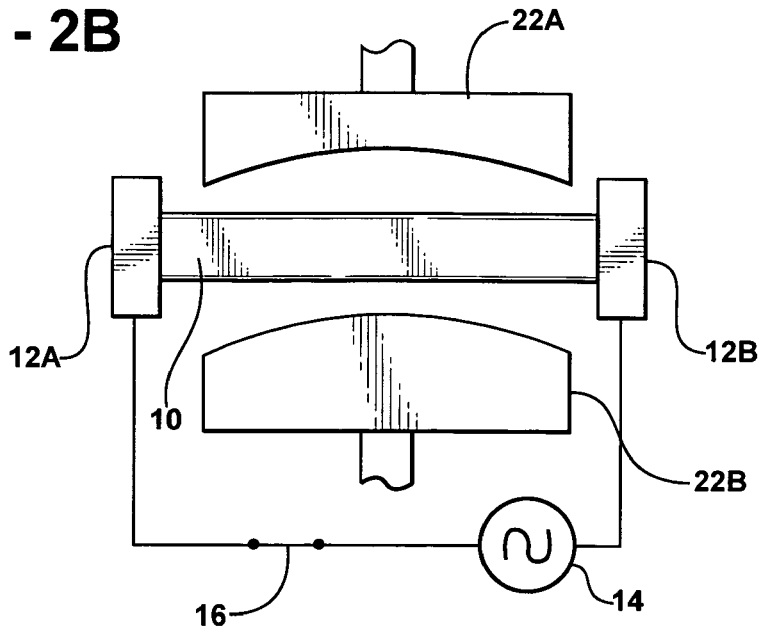
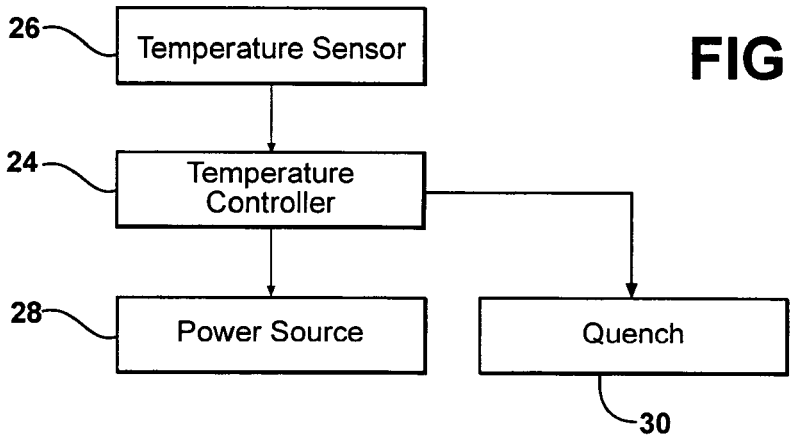
FIG - 3
FIG - 4A
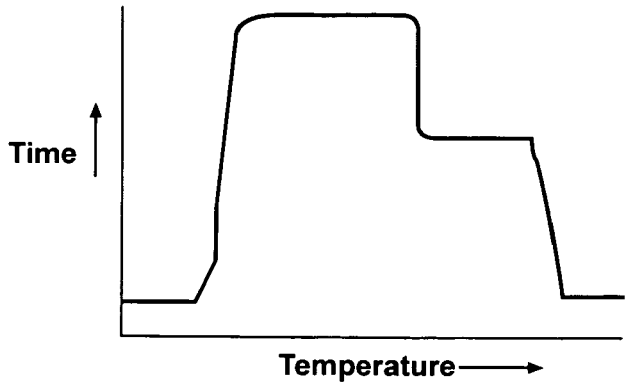

FIG - 4B
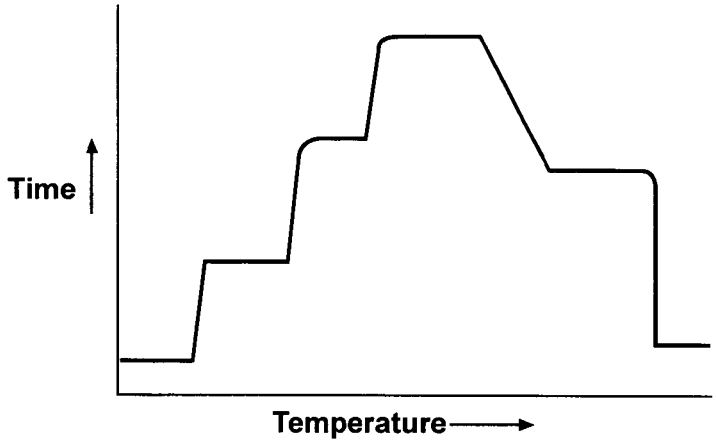
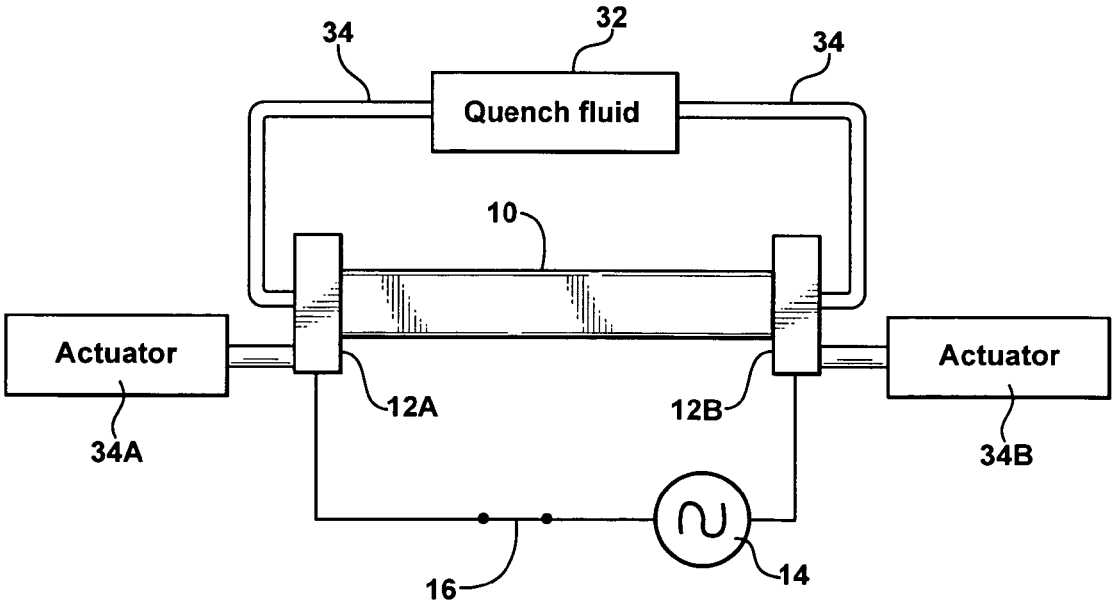
FIG - 5

METAL FORMING APPARATUS AND PROCESS WITH RESISTANCE HEATING

RELATED APPLICATION

This application claims priority of U.S. Provisional Patent Application Ser. No. 60/610,720 filed Sep. 17, 2004, entitled "Metal Forming Process with Resistance Heating."

FIELD OF THE INVENTION

This invention relates generally to apparatus and processes for forming metal articles. More specifically, the invention relates to apparatus and processes for forming metal articles wherein electrical resistance heating is used to heat metal articles. Most particularly, the invention relates to an apparatus and process for forming metal articles wherein the articles may be shaped, heat treated and/or quenched in a single processing station.

BACKGROUND OF THE INVENTION

Many metal forming processes involve steps of heating a workpiece and applying a shaping force to it for the purpose of altering or maintaining a desired shape profile. Temperature control is generally quite important in such processes for the purpose of attaining or maintaining a desired metallurgical state and/or carrying out heat treatment steps such as nitriding, carburizing and the like. Resistance heating, wherein an electrical current is flowed through the workpiece so as to generate heat, is preferred in a number of metal forming processes since resistance heating is very quick and very controllable so that precise temperatures may be achieved and/or selected regions of a workpiece heated.

The prior art has implemented a number of metal forming processes in which resistance heating is combined with various shaping steps such as bending, die forming, stretching and the like. Some such systems are shown, for example, in U.S. Pat. Nos. 5,737,954; 6,463,779; 6,384,388; 5,515,705; 3,933,020; 6,868,709; and 5,744,773.

In various metal working processes, it is necessary to contact a workpiece with a liquid or gaseous fluid during the course of a forming and treatment process. This fluid may comprise a quench fluid used to control the temperature of the workpiece, or it may comprise a treatment fluid such as a species which is chemically reactive with the metal of a workpiece; such treatment fluids may comprise nitriding fluids, carburizing fluids, and the like.

The present invention is directed to a system which integrates heating, shaping, and fluid delivery functions into a single workpiece supporting station. The system of the present invention may be fabricated in modular form, and is amenable to being quickly reconfigured so as to allow for the manufacture of a variety of articles having different profiles and/or different metallurgical properties. As such, the system of the present invention is readily adaptable to high volume manufacturing processes. These and other advantages of the present invention will be explained with reference to the drawings, discussion and description hereinbelow.

BRIEF DESCRIPTION OF THE INVENTION

Disclosed is an apparatus for forming a metal article. The apparatus includes a station which receives and supports a workpiece, a source of electrical current, a source of fluid, and a first and a second electrode clamp. Each clamp is in electrical communication with the source of current, and in fluid communication with the source of fluid. The clamps are configured to engage a workpiece and deliver an electrical current and a fluid thereto. In some embodiments, the system further includes an actuator mechanically associated with at least one of the clamps. The actuator is operable in combination with that at least one clamp to apply a mechanical force to the workpiece.

The apparatus may further include a controller which controls at least one of the source of electrical current and the source of fluid. It may further include a temperature sensor which senses the temperature of the workpiece. In particular embodiments, the temperature sensor is in communication with a controller and is operable in combination with a controller to control the temperature of the workpiece. This control may be in accord with a preselected profile optimized to alter a metallurgical state of, or otherwise heat treat, at least a portion of the workpiece.

Also disclosed are specific embodiments of the invention including a modular apparatus which includes a base station and one or more forming modules engageable therewith. The base station includes a source of electrical current, a controller for controlling the electrical current, a source of fluid, a controller for controlling the source of fluid, and a source of power for powering an actuator device. The forming module includes a first and second electrode clamp which are configured to engage a workpiece and deliver an electrical current and a fluid to the workpiece. The forming module further includes an actuator mechanically associated with at least one of the clamps and operable therewith to apply mechanical force to the workpiece. The forming module further includes a coupler for connecting the module to the base station. The coupler is operable to deliver electrical current from the source of current and fluid from the source of fluid to the clamp and is further operable to deliver power to the actuator.

Also disclosed are methods for forming metal articles utilizing the apparatus of the present invention.

BRIEF DESCRIPTION OF THE DRAWINGS

FIGS. 1A-1F illustrate the basic metal working process implemented by the present invention;

FIG. 2A is a schematic depiction of one specific apparatus of the present invention;

FIG. 2B is a schematic depiction of another specific apparatus of the present invention;

FIG. 3 is a diagram of a temperature control circuit utilized in the present invention;

FIGS. 4A and 4B show particular time/temperature profiles which may be achieved through the use of the system of the present invention;

FIG. 5 is a schematic depiction of another embodiment of the present invention;

DETAILED DESCRIPTION OF THE INVENTION

This invention relates to a metal forming system which employs a flow of electrical current for the purpose of heating a workpiece. Specifically, the system is operable to produce formed metal parts in a process which also allows for heat treating and/or quenching of the parts to selectably control physical properties such as hardness, tempering and the like.

The present invention controls the temperature profile of a workpiece throughout its processing so as to provide finished articles having preferred metallurgical properties; and in that regard, the present invention is operative to sense and adjust the temperature of the workpiece in accord with a predetermined profile.

The process of the present invention combines controlled electrical resistance heating with metal forming techniques including roll forming, die forming, bending, stretching, twisting and quenching. In the context of this disclosure, electrical resistance heating is understood to mean a process wherein a direct or alternating electrical current is applied directly to a workpiece so as to cause the heating of that workpiece. As such, resistance heating is differentiated from induction heating wherein an oscillating electromagnetic field, external to the workpiece, induces corresponding vibrational motion of the electrons in the workpiece so as to cause heating.

In the basic process, an electrical current is applied to a workpiece so as to heat that workpiece. The heated workpiece may be subjected to a shaping force which changes, or in some instances serves to maintain, the configuration of the workpiece. In other instances, the heating alters a metallurgical state of the workpiece. The degree of heating may be controlled with great precision by controlling the flow of electrical current. Subsequent thereto, the electrical current is terminated, and the workpiece allowed to cool. The profile of the cooling may be controlled by use of quenchants. This basic process will best be understood with reference to FIGS. 1A-1E.

Figure 1A:
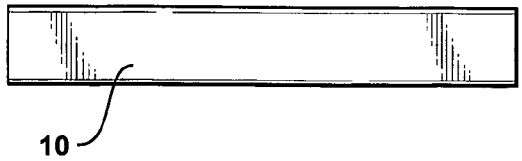

Referring now to FIG. 1A, there is shown a workpiece 10 which comprises a body of metal, typically steel. In some instances, the workpiece 10 may have been subjected to prior metalworking operations such as roll forming, stamping, cutting, piercing and the like. The workpiece may be configured as a solid piece of stock; although, in many instances, the workpiece may comprise a member having a complex profile such as a hollow beam, a C-shaped profile, or other complex shape.

Figure 1B:
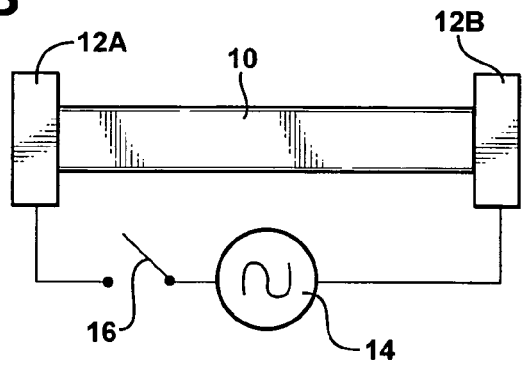

In a first step of the process, as is shown in FIG. 1B, a pair of electrode clamps 12*a*, 12*b* are affixed to the workpiece 10. This is typically done in a fixture which may include further members and functions as is discussed with reference to various of the figures hereinbelow. The electrode clamps 12*a* and 12*b* form an electrically conducting junction to the workpiece 10, and in one preferred embodiment, physically clamp thereonto; although, it is to be understood that otherwise configured electrodes may be employed. Electrode clamps 12*a*, 12*b* are in electrical communication with a source of electrical power, which in this instance is shown as being a generator 14. It is to be understood that batteries and other sources of electrical power, including both sources of alternating current and direct current, may be utilized in the practice of the present invention. The system of FIG. 1B further includes a switch 16 or other controller such as a transformer or rheostat disposed so as to control the flow of electrical current from the generator 14 through the workpiece 10.

Figure 1C:
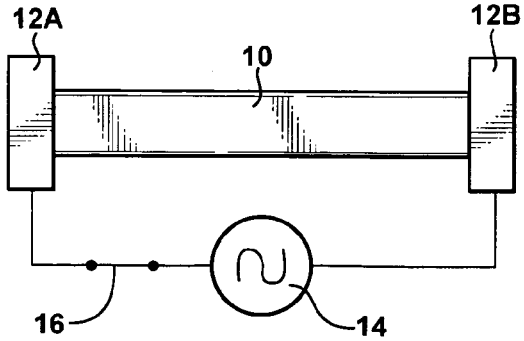

In a subsequent step of the invention as is shown in FIG. 1C, the switch 16 is closed so as to initiate a flow of electrical current through the workpiece 10. The electrical current causes the workpiece 10 to become heated, and the magnitude of the heating may be controlled by controlling the magnitude and/or voltage of the electrical current passing through the workpiece 10. It will be understood that in this manner precise control of the heating of the workpiece may be achieved.

Figure 1D:
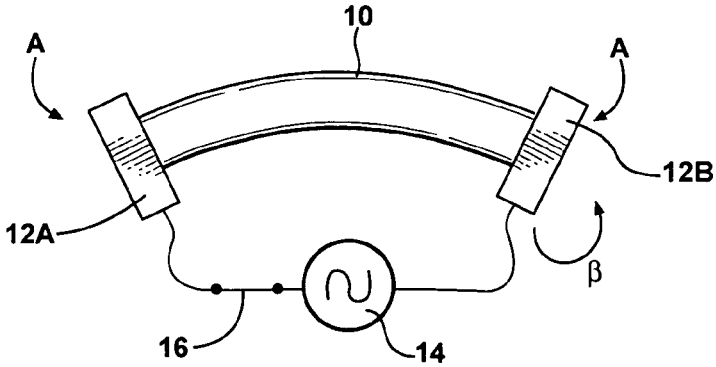

As shown in FIG. 1D, the heated workpiece 10 is subjected to mechanical forces which deform the workpiece in a desired manner. In the FIG. 1D embodiment, the workpiece is bent into a curved profile by mechanical forces applied to and through actuators associated with the clamps 12*a*, 12*b*. Such bending forces are shown by arrows A. As indicated by arrow B, a twist may also be applied to the workpiece 10 via the clamps 12*a* and 12*b*. Likewise, a stretching force may be applied through the clamps. As will be explained in detail hereinbelow, the workpiece may additionally be shaped by mechanical forces applied thereto by other means separate from the clamps, such as dies, actuators and the like. In some instances, shaping may be accomplished by pressurization (i.e. blow-molding), magnetic forming or other such techniques.

Once the workpiece has been appropriately shaped, the flow of electrical current is terminated, as is shown in FIG. 1E, by opening the switch 16. It is to be understood that in some instances, current flow and heating may be terminated prior to or during the forming steps. Following the completion of the shaping operations, the workpiece 10 is preferably quenched or otherwise subjected to a controlled cooling step so as to bring about a desirable metallurgical transition. For example, in a specific embodiment, the workpiece is heated to an austenizing temperature and subsequently worked while relatively soft, and following the working steps, it is quenched to convert the steel to a higher hardness form such as a martensitic or bainite structure. In a final step, the finished workpiece 10 is removed from the clamps 12*a*, 12*b* and the basic process is completed. While the foregoing has described a process wherein a workpiece has its overall shape changed, in some instances, the metalworking process of the present invention will be directed toward maintaining a shape of a member while it is being heated and quenched.

It is to be understood that numerous modifications and variations of this basic process may be implemented within the context of the present invention. As briefly mentioned above, shaping of the metal workpiece may be achieved through any mechanical means known and contemplated in the art. Referring now to FIG. 2A, there is shown another embodiment of the present invention. As in the FIG. 1 embodiments, the FIG. 2A embodiment is operative to heat and shape a workpiece 10, and in that regard includes clamp electrodes 12*a* and 12*b* operating in conjunction with a source of electrical power 14 and a power control switch 16 as previously described. In the FIG. 2A embodiment, the heated workpiece 10 is shaped by a series of mechanical actuators 18*a*-18*l*. One advantage of the FIG. 2A system is that the actuators may be made relatively small and may comprise lower power members. These actuators 18 may comprise hydraulic actuators, pneumatic actuators, or electrically driven actuators. The actuators 18 are disposed so as to be capable of contacting and shaping the workpiece 10 when activated. As previously noted, additional shaping forces may be applied to the workpiece through the electrode clamps 12*a*, 12*b*. As further illustrated, a controller 20 is disposed so as to selectably activate the actuators 18. It will be appreciated that the FIG. 2A embodiment may be implemented as a generic shaping device which is capable of configuring a workpiece 10 into various configurations depending upon which of the actuators 18*a*-18*k* are activated by the controller 20. A system of this type may be employed to produce variously configured articles without requiring significant retooling.

It is to be further understood that the FIG. 2A embodiment may be otherwise modified. For example, various of the actuators may be modified to carry out operations such as piercing, cutting, welding and the like. Also, various of the actuators may be configured to grip, stretch, twist or otherwise deform the workpiece. One advantage of an embodiment incorporating multiple actuators is that any given actuator need not be very powerful since it will be acting in conjunction with a number of other actuators so as to effect a net change in the shape of the workpiece.

Referring now to FIG. 2B, there is shown yet another embodiment of shaping system in accord with the present invention. As in the previous embodiments, the FIG. 2B embodiment includes clamp electrodes 12*a* and 12*b* operating in conjunction with a generator 14 and switch 16 to provide for the heating of a workpiece 10. In this embodiment, a pair of dies 22*a*, 22*b* are operable to shape the workpiece 10. As in the previous embodiments, stretching, twisting or bending forces may be applied to the workpiece by yet other structures including the electrode clamps 12. In this embodiment, the electrode clamps 12*a*, 12*b* may apply a shaping force to the workpiece.

The system of the present invention provides very good temperature control of the workpiece through all stages of the metalworking process. In specific embodiments, a temperature control circuit of the type shown in FIG. 3 may be included in the system. The circuit of FIG. 3 includes a temperature controller 24 which may be a microprocessor based controller, an analog controller or an electromechanical controller. The temperature controller 24 operates to regulate the power source 28 which causes the resistive heating of the workpiece. In specific embodiments of control circuit, the temperature controller also receives temperature information from a temperature sensor 26. The temperature sensor may comprise an optical pyrometer, a thermocouple, or other such temperature measuring device which is in communication with the workpiece. Since the electrical resistivity of the workpiece will vary as a function of its temperature, in some instances, the temperature sensor 26 may be operative to measure the resistivity of the workpiece and so determine its temperature. The temperature controller 24 may be operative to maintain a fixed temperature in the workpiece, or it may be operative to control the temperature in accord with a predetermined profile.

As mentioned above, the system of the present invention preferably operates to quench the heated workpiece in the course of its processing. In this regard, the temperature control circuit of FIG. 3 may also be in electrical communication with a quench system 30 which is operative to deliver a quench liquid or gas to the workpiece. In such instance, the controller 24 senses the temperature of the workpiece and controls the operation of the quench system 30 in response thereto so as to achieve a desired quench profile. Use of a system of this type can permit various portions of the metalworking process to be carried out under very precise temperature control. For example, a metal workpiece may be heated to a temperature which is high enough to facilitate plastic deformation, but low enough to minimize oxide formation. It may then be rapidly heated to a metallurgical transition temperature, held for an appropriate time and cooled at a rate which will produce a desired metallurgical state. For example, use of this system can reliably produce finished parts having a martensite or bainite structure. This control allows high quality parts to be manufactured from low cost, conventional alloys.

FIGS. 4A and 4B show various examples of time/temperature profiles which may be achieved through the use of the system of the present invention. It is to be understood that various other profiles may be implemented utilizing the systems of the present invention.

Referring now to FIG. 5, there is shown yet another feature of the present invention where the electrode clamps 12*a*, 12*b* of the system are further operative to deliver a quench fluid to the heated workpiece. As is shown in FIG. 5, a workpiece 10 is retained and resistively heated by electrode clamps 12*a* and 12*b* which are in electrical communication with a generator 14, via a switch 16 as in the previous embodiments. In this embodiment, the electrode clamps 12*a* and 12*b* are also in communication with a source of quench fluid 32 via fluid lines 34. The quench fluid may comprise any type of quenchant known in the art, and includes, by way of illustration, liquids such as water, oil, water and oil emulsions, organic fluids and the like. The quenchant fluid may also comprise a gas, and in certain instances, the quenchant fluid may comprise a liquefied gas such as liquid nitrogen. In the FIG. 5 embodiment, the clamps 12*a*, 12*b* may be configured so as to direct the quench fluid across the external surface of the workpiece 10. In those instances where the workpiece is a hollow workpiece, the system may be further operative to pass a quenchant fluid through the workpiece. Also shown in FIG. 5 are a pair of actuators 34*a*, 34*b* associated with respective clamps 12*a*, 12*b*. The actuators, as mentioned hereinabove, may comprise hydraulic, pneumatic, electrical or electromechanical actuators and may be operative to stretch, twist or bend the workpiece. In other instances, the system of FIG. 5 may be modified to deliver another fluid, such as a carburizing fluid, a nitriding fluid or an inert fluid to the workpiece during its processing. This other fluid may be used in conjunction with, or instead of, the quenchant fluid.

In all of the embodiments shown above, the electrode clamps are shown as being disposed at the ends of the workpiece. In some instances, it may be desirable to otherwise dispose the clamps. For example, if only certain portions of the workpiece are to be subjected to a heat treatment cycle, the clamps may be disposed so as to deliver electrical current only to those portions of the workpiece. Accordingly, all of such embodiments are within the scope of this invention. Also, in some instances, certain portions of a workpiece may be subjected to specific heat treatment steps separate from the heat treatment steps applied to the remainder of the workpiece. For example, an entire workpiece may be heat treated so as to induce a first metallurgical transition therein, and selected portions of that workpiece then retreated to convert those selected portions to a second metallurgical state. For example, a workpiece may be so processed to produce a high hardness member having selected areas of low hardness therein.

Such a configuration can provide for energy-dissipating structures such as bumper bars, crash protected beams and the like having a preselected set of deformation characteristics optimized to attenuate mechanical impacts. In other instances, specific regions of a member can be heat treated to provide hardness characteristics optimized for subsequent processing steps such as welding, tapping, cutting and the like. For example, use of the methods of the present invention can produce a high hardness beam member having a lower hardness flange or tab extending therefrom.

Figure 6:
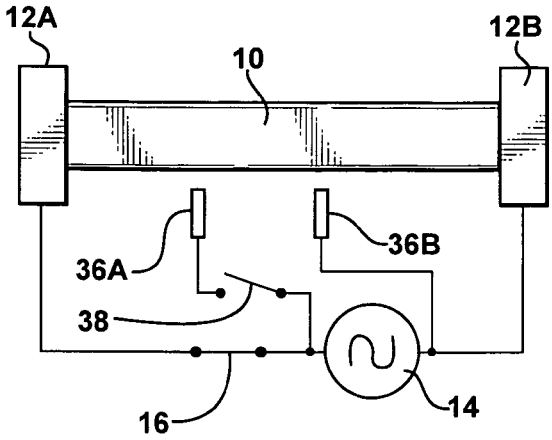
FIG. 6 is a schematic depiction of yet another embodiment of the present invention.

FIG. 6 depicts another embodiment of the present invention as specifically configured to provide for separate heat treatment of a portion of a workpiece. As is shown in FIG. 6, a workpiece 10 is supported by electrode clamps 12*a*, 12*b* which in turn are energized by a power source such as a generator 14 via a switch 16 all as previously described. The FIG. 6 embodiment further includes a second set of electrodes 36*a*, 36*b* which are in electrical communication with the generator 14 and selectively activatable via a second switch 38. This second set of electrodes 36*a*, 36*b*may be selectably contacted to the workpiece 10, and when a current is passed therethrough, they cooperate to resistively heat portions of the workpiece 10 disposed therebetween. Although not illustrated, it is to be understood that the FIG. 6 embodiment may include means for carrying out forming operations on the workpiece, in accord with previous discussions.

In the use of the FIG. 6 embodiment, a workpiece 10 may first be heated to a desired metallurgical transition temperature via electrode clamps 12*a* and 12*b*, subsequently formed, and optionally quenched. In further steps, the auxiliary electrodes 36*a*, 36*b* may be activated to reheat portions of the workpiece 10 so as to reverse temper those portions, or otherwise effect a metallurgical transition. Such reheating may optionally be accompanied by further processing steps such as shaping steps, quenching steps and the like.

Figure 7:
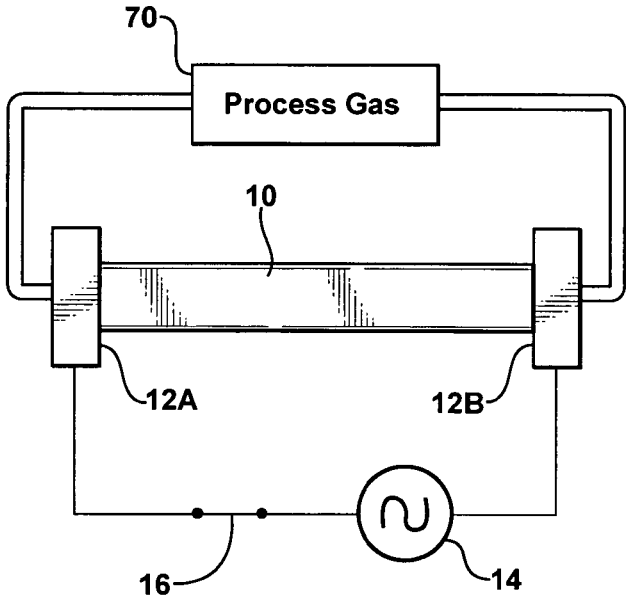
FIG. 7 is a schematic depiction of a further embodiment of the present invention.

In accord with another aspect of the present invention, the metal forming system may be further operative to provide a controlled atmosphere to the workpiece during selected stages of its processing. Referring now to FIG. 7, there is shown one such embodiment. As is specifically shown therein, a workpiece 10 is supported by electrode clamps 12*a* and 12*b* which may include a mechanical actuator as previously described. In this specific embodiment, the electrode clamps 12*a* and 12*b* are further configured so as to deliver a process gas to the workpiece 10 from a process gas source 70. The process gas may comprise an inert gas such as nitrogen, argon or the like. In other instances, the process gas may comprise a reducing gas such as hydrogen, a nitriding gas such as ammonia or the like, or a carburizing gas such as a hydrocarbon. The system may be configured so as to deliver the process gas to the external surface of a workpiece; and in those instances where the workpiece is a hollow workpiece, it may also be operative to deliver process gas to the interior thereof.

In those instances where the process gas is an inert gas, formation of undesired oxide and/or other scale on the heated workpiece may be eliminated or minimized. This is a very significant feature of the present invention since elimination of scale will result in the production of higher quality items and/or facilitate further processing of the finished workpieces. Use of an inert atmosphere will also extend the time period during which operations can be carried out on the heated workpiece since time constraints resultant from oxide and scale formation will be eliminated. In many instances, prior art systems for forming heated workpieces require that particular high cost steel alloys be utilized in order to avoid undue scale and oxide formation. Use of the present invention eliminates this cost factor.

Various systems for carrying out the method of the present invention may be implemented. Within one aspect of the present invention, it is contemplated that a modular metal-working system may be fabricated. In such a system, specific modules may be configured so as to carry out particular groups of operations on particular workpieces. Such modules may include particular configurations of electrodes, forming members, fluid delivery systems and the like. The particular configuration of each operational module will depend upon the nature of the article being fabricated therein. In this embodiment of the invention, modules may be configured so as to be engageable with a "universal" control system. The control system will contain common units such as the electrical supply system, pneumatic systems, hydraulic systems, fluid delivery systems and the like. In this manner, the apparatus may be readily configured for the manufacture of different articles by substituting modules thereinto.

Figure 8:
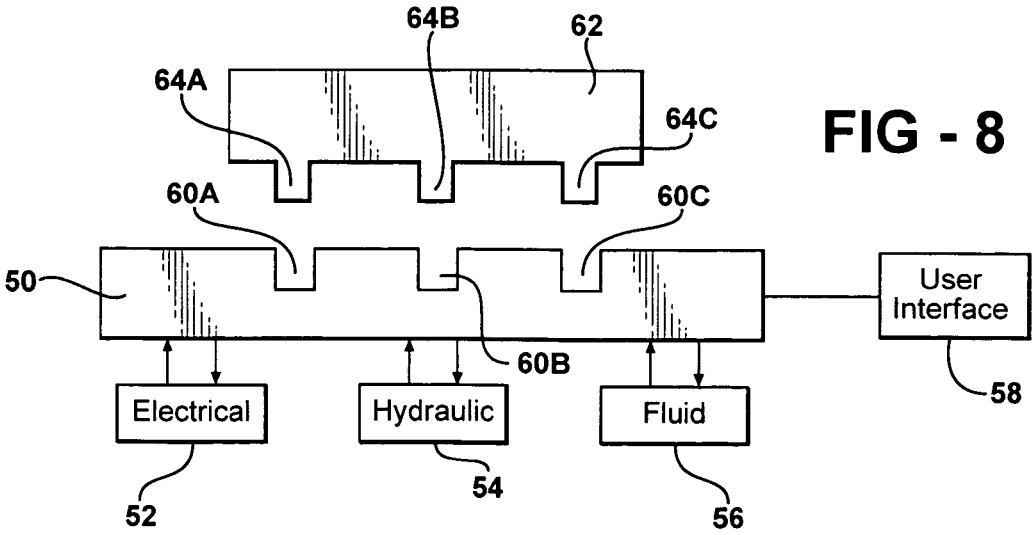
FIG. 8 is a schematic depiction of a modular system structured in accord with the present invention.

Referring now to FIG. 8, there is shown a schematic depiction of this embodiment of the present invention. As shown therein, a base station 50 includes an electrical control system 52, a hydraulic control system 54, and a fluid control system 56, associated therewith. The base station 50 also includes a user interface 58 which may include computer controllers, data input devices such as keyboards, touch screens and the like, as well as data display devices allowing for operator control of the system. The base station 50 includes a series of connector ports 60*a*, 60*b*, 60*c* which include fluid delivery lines, electrical connections, pneumatic or fluidic connections and the like. The base station 50 is configured to receive an operational module 62 which, as previously described, may include fixturing and actuators for receiving and forming a workpiece, as well as sensors and other associated systems. The module 62 includes connectors 64*a*, 64*b*, 64*c* which engage corresponding connector terminals 60*a*-60*c* on the base station. When module 62 is engaged with the station 50, the system will be operative to carry out a series of forming operations on a workpiece in accord with those aspects of the invention described hereinabove.

The foregoing describes some specific embodiments of the present invention. Features found in these various embodiments may be combined and/or modified to provide other systems and apparatus in accord with this invention. Yet other modifications, combinations and variations of the present invention will be apparent to those of skill in the art. The foregoing drawings, discussion and description are illustrative of some specific embodiments of the present invention, but are not meant to be limitations upon the practice thereof. It is the following claims, including all equivalents, which define the scope of the invention.

The invention claimed is:

1. An apparatus for forming a hollow metal article, said apparatus comprising:

a station for receiving and supporting a hollow workpiece;

a source of electrical current;

a source of a fluid;

a first and a second electrode clamp, each clamp being in electrical communication with said source of current;

a fluid line which is in fluid communication with said source of a fluid, said fluid line being directly coupled to at least one of said clamps, said at least one clamp being operable to pass said fluid through the interior of said hollow workpiece;

said clamps being configured to engage a hollow workpiece and to deliver an electrical current to the hollow workpiece, and to flow a fluid therethrough.

2. The apparatus of claim 1, further including an actuator mechanically associated with at least one of said clamps, said actuator being operable, in combination with said at least one clamp, to apply a mechanical force to said workpiece.

3. The apparatus of claim 1, further including a controller for controlling at least one of said source of electrical current and said source of a fluid.

4. The apparatus of claim 3, further including a temperature sensor for sensing the temperature of the workpiece.

5. The apparatus of claim 4, wherein said temperature sensor is in communication with said controller and is operable in combination therewith to control the temperature of said workpiece.

6. The apparatus of claim 5, wherein said controller is operable to control the temperature of the workpiece in accord with a preselected profile.

7. The apparatus of claim 5, wherein said controller is operable to control the temperature of said workpiece so as to alter a metallurgical state of at least a portion of the workpiece.

8. The apparatus of claim 7, wherein said controller is operable to alter the metallurgical state of at least a portion of said workpiece so as to convert said portion to a martensitic or bainitic structure.

9. The apparatus of claim 2, wherein the mechanical force applied to said workpiece is selected from the group consisting of bending, twisting, stretching, holding, and combinations thereof.

10. The apparatus of claim 2, wherein said actuator is selected from the group consisting of hydraulic actuators, pneumatic actuators, electromechanical actuators, and combinations thereof.

11. The apparatus of claim 1, wherein said fluid is a liquid.

12. The apparatus of claim 1, wherein said fluid is a gas.

13. The apparatus of claim 1, wherein said fluid is a quench fluid.

14. The apparatus of claim 1, wherein said fluid is a process fluid.

15. A modular apparatus for forming a metal article, said apparatus comprising:

a base station comprising a universal control system, said base station including:

a source of electrical current;

a controller for controlling said electrical current;

a source of a fluid; and a controller for controlling said source of a fluid;

a plurality of operational modules, each operational module configured to carry out a particular group of operations on a particular workpiece, each module comprising:

a first and a second electrode clamp, said clamps being configured to engage a workpiece and to deliver an electrical current and a fluid to said workpiece; and a coupler operable to selectably connect and disconnect each of said operational modules to said base station, said coupler being further operable to deliver electrical current from said source of electrical current, and fluid from said source of a fluid, to said clamp; whereby when a selected member of said plurality of operational modules is interchangeably connected to said base station, said apparatus is configured to carry out a particular group of operations on a workpiece, and whereby when a different selected member of said plurality of operational modules is connected to the base station, said apparatus is configured to carry out another particular group of operations on a workpiece.

16. The modular apparatus of claim 15, wherein said base station further includes a source of power for powering an actuator device; and wherein at least one of said operational modules further includes an actuator mechanically associated with at least one of said clamps, said actuator being operable in combination with said at least one clamp to apply a mechanical force to said workpiece; and said coupler is further operable to deliver power from said source of power to said actuator.

* * * * *